US006138841A

United States Patent [19]

Klein et al.

[11] Patent Number: 6,138,841

[45] Date of Patent: Oct. 31, 2000

[54] HANGING RACK FOR SPORTS EQUIPMENT

[75] Inventors: Richard B. Klein, Overland Park; Chris Serslev, Leawood; John W. Scott, Lenexa, all of Kans.

[73] Assignee: Lynk, Inc., Lenexa, Kans.

[21] Appl. No.: 09/226,906

[22] Filed: Jan. 8, 1999

[51] Int. Cl.[7] ..... A47F 7/00

[52] U.S. Cl. ..... 211/85.7; D6/552; 248/214; 211/14; 211/113

[58] Field of Search ..... 211/85.7, 14, 113, 211/118, 35, 87.01; 248/214, 215; D6/552

[56] References Cited

U.S. PATENT DOCUMENTS

| | | | |
|---|---|---|---|
| D. 85,502 | 11/1931 | Wilhelm . | |
| D. 139,415 | 11/1944 | Brown . | |
| D. 287,550 | 1/1987 | Tocci | D6/315 |
| D. 308,813 | 6/1990 | Robinson | D8/307 |
| D. 324,787 | 3/1992 | Evans | D6/411 |
| D. 333,731 | 3/1993 | Klein et al. | D6/317 |
| D. 334,292 | 3/1993 | Klein et al. | D6/317 |
| D. 341,500 | 11/1993 | Klein et al. | D6/411 |
| D. 354,412 | 1/1995 | Emery | D6/548 |
| D. 377,728 | 2/1997 | Klein et al. | D6/570 |
| D. 381,225 | 7/1997 | Malik | D6/513 |
| D. 382,434 | 8/1997 | Klein et al. | D6/570 |
| D. 385,481 | 10/1997 | Klein et al. | D8/373 |
| D. 386,668 | 11/1997 | Klein et al. | D8/376 |
| D. 388,619 | 1/1998 | Klein et al. | D6/323 |
| D. 397,565 | 9/1998 | Klein et al. | D6/513 |
| D. 403,187 | 12/1998 | Klein et al. | D6/513 |
| 953,130 | 3/1910 | Fellows . | |
| 1,086,200 | 2/1914 | Michie | 211/16 |
| 1,733,487 | 1/1929 | Hackley . | |
| 1,769,344 | 7/1930 | Hoffmire . | |
| 1,927,997 | 9/1933 | Weston | 211/38 |
| 2,067,095 | 1/1937 | Pease | 211/34 |
| 2,090,108 | 8/1937 | Cicero | 211/35 |
| 2,137,029 | 11/1938 | Scholl | 211/37 |
| 2,152,192 | 3/1939 | Hoffman | 211/34 |
| 2,238,884 | 4/1941 | Hoffman | 211/38 |
| 2,276,141 | 3/1942 | Atkinson | 211/37 |
| 2,299,021 | 10/1942 | Hoffman | 211/34 |
| 2,620,929 | 12/1952 | Sportsman | 211/42 |
| 2,682,955 | 7/1954 | Moore | 211/35 |
| 3,171,542 | 3/1965 | Jacobs et al. | 211/43 |
| 3,391,793 | 7/1968 | Streuli | 211/43 |
| 3,637,084 | 1/1972 | Uitz | 211/105.1 |
| 3,695,190 | 10/1972 | Bucholz | 211/148 |
| 3,888,353 | 6/1975 | Leifheit | 211/37 |
| 3,913,745 | 10/1975 | Weiss | 211/34 |
| 3,918,670 | 11/1975 | Doherty | 248/214 |
| 3,974,917 | 8/1976 | Waxmanski | 211/36 |
| 3,999,734 | 12/1976 | Gibson et al. | 248/460 |
| 4,199,070 | 4/1980 | Magnussen, Jr. | 211/60 R |
| 4,209,098 | 6/1980 | Adams | 211/60 R |
| 4,383,722 | 5/1983 | Weber | 312/324 |
| 4,457,436 | 7/1984 | Kelley | 211/88 |
| 4,607,753 | 8/1986 | Radek | 211/87 |
| 4,673,092 | 6/1987 | Lamson et al. | 211/188 |
| 4,678,151 | 7/1987 | Radek | 248/220.2 |

(List continued on next page.)

*Primary Examiner*—Robert W. Gibson, Jr.
*Attorney, Agent, or Firm*—Shook, Hardy & Bacon, L.L.P.

[57] ABSTRACT

A sports equipment rack for supporting sports equipment in an angular manner. A pair of side frame members having an elongate main body section and a plurality of support arms projecting outwardly and upwardly from each main body section. Pairs of retaining bars are positioned on said support arms and are aligned in a plane forming an acute angle with respect to vertical, to thereby support thereon sports equipment in an angular manner, with the equipment directed downwardly toward a vertical surface upon which the shoe rack is placed. The support arms, upon opposite side frames, traverse side sections of the equipment to form a barrier against lateral movement of the equipment. Additionally, each side frame member includes a unique prong for hanging the rack on an upright surface such as a door. A pair of cross bars are positioned between the opposing side members. A plurality of outwardly opening hooks are slidably attached to said pair of cross bars. Further, a pair of unique bat holding members are fastened to at least one of the support arms.

39 Claims, 4 Drawing Sheets

U.S. PATENT DOCUMENTS

| | | | |
|---|---|---|---|
| 4,688,681 | 8/1987 | Bergeron | 211/36 |
| 4,688,687 | 8/1987 | Pryor | 211/189 |
| 4,711,419 | 12/1987 | Polosky | 248/225.2 |
| 4,819,814 | 4/1989 | Fogelgren | 211/50 |
| 4,854,456 | 8/1989 | Lee | 211/14 |
| 4,899,971 | 2/1990 | Elkin | 248/225.1 |
| 4,936,467 | 6/1990 | Bobeczko | 211/14 |
| 4,940,150 | 7/1990 | Spengler | 211/188 |
| 4,942,498 | 7/1990 | Toussaint | 361/388 |
| 4,944,480 | 7/1990 | Jarrett | 248/309.1 |
| 5,035,332 | 7/1991 | Stravitz | 211/40 |
| 5,048,698 | 9/1991 | Konrad | 211/45 |
| 5,078,270 | 1/1992 | Campbell | 206/444 |
| 5,097,968 | 3/1992 | Gregory | 211/94 |
| 5,101,986 | 4/1992 | Holztrager | 211/13 |
| 5,101,989 | 4/1992 | Jones | 211/94 |
| 5,103,985 | 4/1992 | Davis | 211/37 |
| 5,152,407 | 10/1992 | Massoudnia et al. | 211/181 |
| 5,172,816 | 12/1992 | Kline et al. | 211/37 |
| 5,178,287 | 1/1993 | Klein et al. | 211/100 |
| 5,415,297 | 5/1995 | Klein et al. | 211/40 |
| 5,558,307 | 9/1996 | Klein et al. | 248/309.1 |
| 5,617,959 | 4/1997 | Klein et al. | 211/37 |
| 5,695,073 | 12/1997 | Klein et al. | 211/35 |
| 5,855,279 | 1/1999 | Klein et al. | 211/35 |
| 5,871,105 | 2/1999 | Whitehead et al. | 211/14 |

HANGING RACK FOR SPORTS EQUIPMENT

BACKGROUND OF THE INVENTION

1. Field of the Invention

The present invention relates in general to a hanging rack for sports equipment. In particular, the present invention is directed to a hanging rack for sports equipment which supports equipment in an inclined manner, such that the equipment is sloped downwardly toward the vertical surface upon which the rack is attached.

2. Description of the Related Art

A wide variety of equipment is used to participate in sports. If a person or family participates in a number of sports, a significant quantity of equipment is accumulated. Typically, the accumulation includes various types of equipment including balls, bats, hats, shoes, racquets, and protective equipment. Due to the different shapes and sizes of the equipment, the equipment is difficult to store in an organized and accessible manner. Also, if the equipment is not stored efficiently, it may occupy a large volume of space within one's home that could be utilized for another purpose.

The prior art storage devices are particularly inept for storing balls of various sizes. If balls are stored in a large container such as a box or canister, the balls take up a great deal of the space, and balls not located near the top of the container are difficult to identify and remove. The use of chutes also is limited by the diameter of the chute and the inaccessibility of balls in the middle of the chute. Also, conventional racks such as those used to store basketballs are unsuitable for storing a variety of balls. These racks typically include horizontal pairs of parallel retaining members. The members are usually spaced from one another at a selected distance so that balls with diameters significantly different from the diameter of a basketball may not be stored on the rack. Further, when the rack is set into motion, the balls easily tumble from their positions on the rack.

It has been found that hanging a storage device to a vertical surface, such as one side of a door, is advantageous for storing various items in a compact and efficient manner. Specifically, hanging shoe racks have been utilized to organize and store a large number of shoes. One known prior art rack for storing shoes, U.S. Pat. No. 5,695,073 to Klein et al., discloses a shoe rack which is suspended from a vertical surface. The shoe rack has opposing main body sections. A plurality of support arms project outwardly and downwardly from each main body section. Retaining bars are positioned between opposing support arms at the base and end of the support arms. Shoes are placed on the outer retaining bar of one pair of opposing support arms and the inner retaining bar of the next lower pair of opposing support arms.

Thus, the shoes are directed downwardly into contact with the vertical surface on which the rack is hung. The downwardly extending support arms traverse the sides of the shoes to prevent them from sliding laterally off the rack.

The shoe rack disclosed in U.S. Pat. No. 5,695,073 is particularly effective for retaining various types of shoes. However, it is relatively ineffective for retaining many other types of sports equipment. First, if the equipment is too large or too small, it may not be supported by the retaining bars of the shoe rack. Also, the spacing between the support arms does not allow equipment of different sizes and shapes to be stored compactly and efficiently. Additionally, the rack disclosed in the prior art patent can not effectively support irregular shaped equipment such as, for instance, baseball bats and tennis rackets.

Accordingly, the need exists for a compact hanging rack capable of storing a number of pieces of sports equipment varying in both shape and size. The present invention fills this and other needs, and overcomes the problems associated with the prior art.

SUMMARY OF THE INVENTION

An object of the present invention is to provide a sports equipment rack which supports sports equipment of various shapes and sizes in an manner declining downwardly toward a vertical surface.

Another object of the present invention is to provide a sports equipment rack to prevent equipment from sliding or rolling laterally off of the sports equipment rack.

It is a further object of this invention to provide a sports equipment rack capable of holding many shapes and sizes of commonly used sports equipment.

Another object of this invention is to provide a sports equipment rack which retains equipment when the rack is secured to a swinging door.

It is further object of this invention to provide a sports equipment rack which retains both baseballs and softballs in a secure and compact manner.

These and other objects are achieved by a sports equipment rack having side frame members which securely retain a plurality of equipment retaining bars therebetween.

The side frame members are secured to, or hang from, a vertical surface such as a wall or door. The present sports equipment rack includes an integrally formed, downwardly extending prong received within an opening of a hanger which is hung on the vertical surface. The outer surface of the prong is co-planar with the back face of the main body section of the rack. The unique design of the prong allows the rack to be firmly secured yet easily removed from the hangers.

The side frame members include a main body section and a plurality of support arms projecting outwardly and upwardly therefrom. Corresponding support arms formed upon opposing main body sections securely retain opposite ends of a first retaining bar at a position proximate the outer end of each support arm. A second retaining bar is retained on the corresponding support arms at a position between the first retaining bar and the main body sections. The first and second retaining bars are aligned in a plane forming an acute angle with respect to the vertical surface to thereby support the equipment in an inclined manner with the equipment directed downwardly toward the upright surface.

From the vertically highest support arm to the lowest support arm, the distance between the retaining bars is decreasingly smaller. Also, the distance between the support arms on the main body section decreases from the top to the bottom of the rack. The retaining bars are particularly advantageous for storing a numerous and diverse collection of sports equipment in a compact and accessible manner. Particularly, the retaining bars are especially effective for storing basketballs, soccer balls, shoes, and softballs.

Additionally, in accordance with a key aspect of the present invention, bracing members are formed which traverse the sides of the equipment to form a barrier against lateral movement of the equipment, thereby preventing equipment from sliding or rolling off the rack.

Additionally, each side frame member terminates at a hooked lower end. Also, a pair of cross bars are secured between the main body sections at the lower ends of the opposing side frame members. A plurality of hooks are slidably fastened to the cross bars. Additionally, bat holding members are attached to at least one of the support arms.

The vertically lowest pair of retaining bars and the upper cross bar are particularly effective for retaining shoes. Further, the inner retaining bar and upper cross bar are exceptionally effective for storing softballs and preventing other equipment stored between the retaining bars from falling from the rack if the equipment is displaced from the retaining bars.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
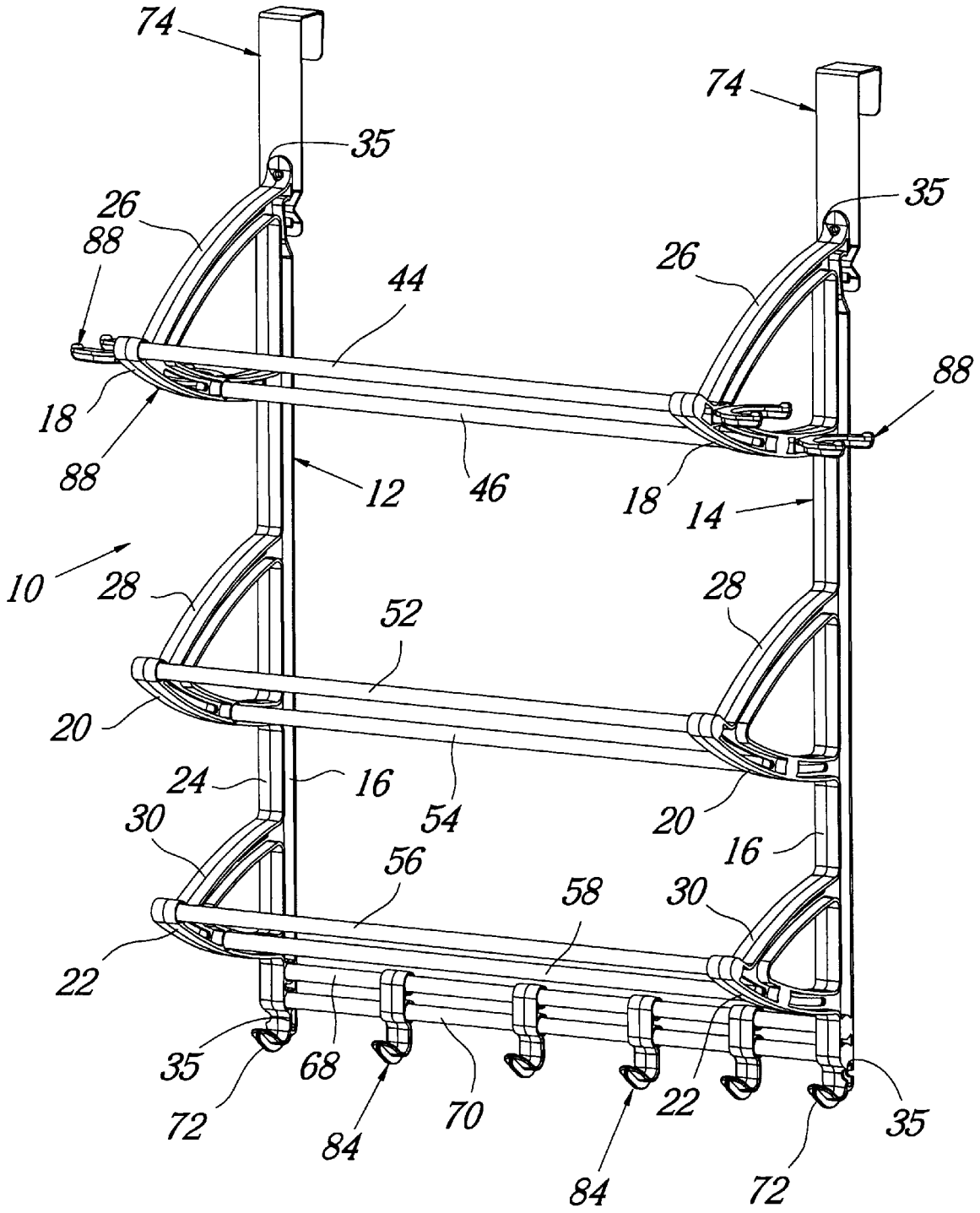
FIG. 1 is a right, frontal perspective view of a sports equipment rack according to the present invention.

With reference initially to FIG. 1, a sports equipment of the present invention is denoted generally by reference numeral 10. Sports equipment rack 10 has first and second side frame members 12, 14. Each side frame member 12, 14 includes a main, elongate body section 16, a plurality of support arms 18, 20, and 22, and corresponding bracing members 26, 28 and 30.

Figure 2:
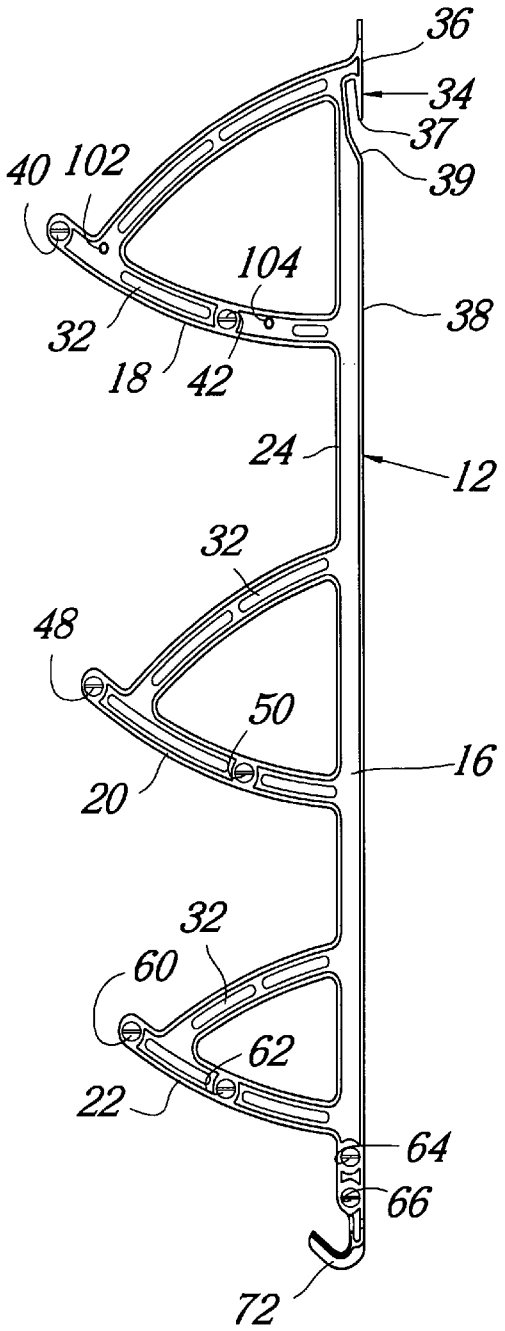
FIG. 2 is a right, side elevation view illustrating one of the main body sections of the sports equipment rack of the present invention.

With additional reference to FIG. 2, each side frame member 12, 14 is preferably fabricated, in the form of an I-beam, as one integral piece of plastic and channels 32 are formed throughout the support arms and corresponding bracing members. Specifically, each side frame member 12, 14 is preferably formed of thermal plastic molding compound. The support arms 18, 20 and 22 project outwardly and upwardly from front face 24 of main body section 16. Preferably, the support arms 18, 20 and 22 are upwardly concave. Bracing members 26, 28, and 30 are arcuate and project downwardly from front fact 24 of main body section 16 and join corresponding support arms 18, 20 and 22 proximate the terminal ends.

Body section 16 of each side frame member 12, 14 includes a downwardly extending prong 34 formed near the intersection of bracing member 26 and body section 16. The prong 34 becomes decreasingly smaller until terminating at its rounded tip 37. The inner surface of prong 34 forms an angular and upwardly directed slot between prong 34 and the remainder of main body section 16, which is molded so as to angle toward the front face 24, as indicated by reference numeral 39, thus creating the slot between prong 34 and main body section 16. Outer surface 36 of prong 34 is co-planar with back face 38 of main body section 16.

Sports equipment rack 10 is adapted to be supported on a vertical surface, such as a wall or door. For hanging sports equipment rack 10 over a door, a pair of hangers 74 are placed over the top of the door, and engage with the prong 34 of rack 10 to support rack 10 in a suspended fashion in engagement with the vertical surface of the door. As disclosed in U.S. Pat. No. 5,695,073, assigned to the assignee of the present invention, and incorporated herein by reference, each hanger 74 is preferably in the form of a metallic bracket having a horizontal upper portion 75 and downwardly depending front and rear portions 76, 77, respectively, depending downwardly from respective front and rear edges of the upper horizontal surface. Preferably, the downwardly depending front portion 76 includes a portion, designated by the reference numeral 78, angled into a V-shape including angled portions 79, 80 which meet at an outwardly protruding apex 81. Each angled portion 79, 80 includes an opening 83 adapted to receive prong 34 of the corresponding side frame members 12, 14 of sports rack 10. The inverted "U" formed by each hanger 74 is adapted to hang over the top of the door, thus rigidly supporting sports rack 10 in a suspended fashion on the door.

In the preferred embodiment, prong 34 is integrally formed within main body section 16. However, prong 34 could be formed as part of a separate extension attached to the top of main body section 16. Also, more than one prong could be formed on main body section 16, for increased support integrity, if desired. If prong 34 is not utilized, a screw, nail, or other fastener may be placed through the apertures 35 of main body sections 16 to secure sports equipment rack 10 to the upright surface.

Sockets 40 and 42 are formed on support arm 18 of frame members 12, 14. Socket 40 is positioned proximate the outer end of support arm 18, and socket 42 is positioned on support arm 18 between socket 40 and the intersection of support arm 18 and body section 16. A pair of retaining bars 44 and 46 are secured within sockets 40 and 42 of opposing support arms 18. Retaining bars 44 and 46 are secured to support arms 18 to form an acute angle with respect to main body sections 16 of side frame members 12, 14.

When sports equipment is placed on retaining bars 44 and 46, the equipment is directed in an angular manner towards the vertical surface on which sports equipment rack 10 is hung. In the preferred embodiment, the acute angle between the retaining bars 44 and 46 and the upright surface is preferably between 63° and 72°, and, most preferably, is about 68°. The first pair of retaining bars 44 and 46 are particularly useful for retaining large balls such as basketballs. The distance between retaining bars 44 and 46 preferably ranges from 4.5 to 6.5 inches, and is most preferably about 5.4 inches. The perpendicular distance between the center of retaining bar 44 and the upright surface is between 8 and 10 inches, and is most preferably about 9 inches. The perpendicular distance between the center of retaining bar 46 and the upright surface is preferably between 3.5 and 4.5 inches, and in the preferred embodiment is about 4 inches. Bracing members 26 extending outwardly and downwardly from front face 24 to prevent equipment from sliding or rolling off of the sports equipment rack 10 when resting on retaining bars 44 and 46. Preferably, the bracing members 26 are arcuate and downwardly concave so that equipment such as large balls may not roll over the upper surface of the members.

The other bars are similarly fixed to the support arms of the sports equipment rack 10. Socket 48 is formed at the end of arm 20 and socket 50 is formed and at an intermediate position on each support arm 20. Retaining bar 52 is coupled to side frame members 12, 14 at socket 48, and retaining bar 54 is coupled to side frame members 12, 14 at socket 50. The distance between retaining bars 52 and 54 is preferably between 4 and 6 inches, and, most preferably, is about 4.9 inches. The perpendicular distance between the center of retaining bar 52 and the upright surface is preferably between 7 and 9 inches, and in the preferred embodiment is about 8 inches. The perpendicular distance between the center of retaining bar 54 and the upright surface is preferably between 3 to 4 inches, and, most preferably, is about 3½ inches. The spacing of retaining bars 52 and 54 is particularly advantageous for retaining volleyballs and soccer balls. Retaining bars 52 and 54 are preferably oriented with respect to body sections 16 at an acute angle of between 60° and 70°, and, most preferably, the angle is about 66°. Bracing members 28 of side frame members 12, 14 prevent equipment from sliding or rolling off sports equipment rack 10.

Finally, retaining bars 56 and 58 arc received within sockets 60 and 62 placed at the end and at an intermediate position on support arms 22. The distance between retaining bars 56 and 58 is preferably between 2.5 and 3.5 inches, and most preferably is about 3.1 inches. The perpendicular distance between the center of retaining bar 56 and the upright surface is preferably between 6 and 8 inches and, most preferably, is about 7 inches. The perpendicular distance between the center of retaining bar 58 and the upright surface is preferably between 3.5 and 4.5 inches and, most preferably, is about 4 inches. These dimensions arc particularly effective for retaining small balls, such as baseballs, on retaining bars 56 and 58. The retaining bars are oriented with respect to main body section 16 to form an acute angle generally between 60° and 70°, and, most preferably, about 65.5°.

The distance between the pairs of retaining bars becomes decreasingly smaller from the top pair 44 and 46 to the bottom pair 56 and 58. Also, the distance between the support arms decreases from the top to the bottom of the rack. In the preferred embodiment, the distance between bases of support arms 18 and 20 is about 10 inches, and the distance between the bases of support arms 20 and 22 is about 7½ inches. The design prevents the retaining bars from obstructing the user when placing equipment on the rack or removing equipment from the rack. Further, the configuration of the rack allows a large amount of equipment to be stored in a compact and efficient manner.

Figure 4:
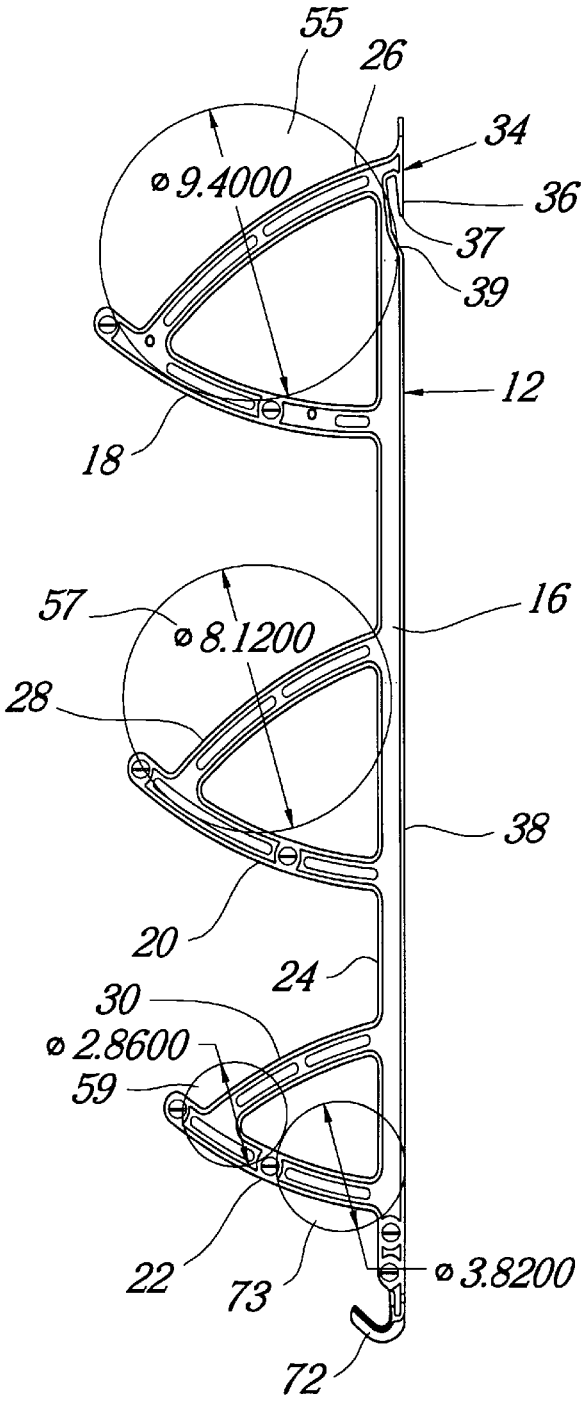
FIG. 4 is a right, side elevation view of one of the main body sections demonstrating various balls retained on the sports equipment rack of the present invention.
Figure 5:
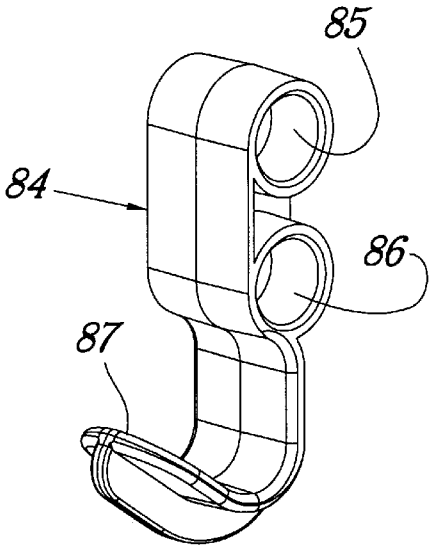
FIG. 5 is a right, frontal perspective view of a hook member utilized with the present invention.

As best shown in FIG. 4, balls such as a basketball 55 may be placed on retaining bars 44 and 46. The basketball 55 is firmly supported by the bars 44 and 46 and is positioned so that a small space is defined between the basketball 55 and the vertical surface. Thus, while the basketball 55 is not supported by the vertical surface, the surface may guide balls between retaining bars 44 and 46. For instance, if a small child can not reach above the rack to place the ball in between the retaining bars 44 and 46, the child may push the ball over retaining bar 44. If the ball does not initially settle between the bars 44 and 46, the vertical surface will force the ball back towards the bars until the ball reaches a static position. Similarly, if the sports equipment rack 10 is placed on the side of a swinging door, the vertical surface and retaining bar 44 will prevent the ball from displacing from the rack 10. Also, the second pair of retaining bars 52 and 54 are particularly effective for retaining volleyballs 57 having a conventional diameter of about 8.16 inches. Further, the third pair of retaining bars 56 and 58 are extremely effective for storing conventional baseballs 59 having a diameter of about 2.86 inches. The orientation of the first and second pairs of bars are also well suited for supporting footballs.

At the lower end of body section 16, two additional sockets 64 and 66 are formed between front face 24 and back face 38 of body section 16. At the lower end of main body section 16 and below sockets 64 and 66, a hook 72 is formed. Hook 72 opens outwardly from the upright surface on which rack 10 is hung.

Figure 3:
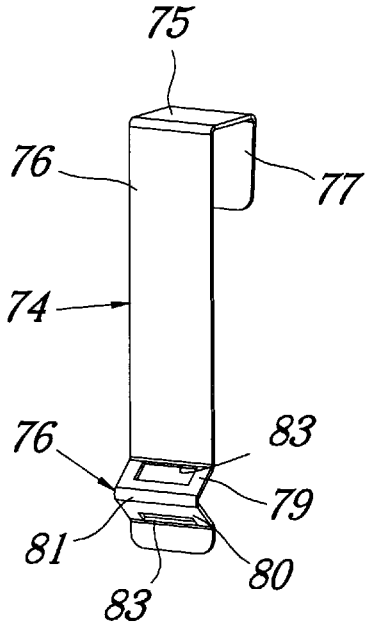
FIG. 3 is a right, frontal perspective view of a hanger utilized with the present invention.

A pair of horizontal support members, cylindrical cross bars 68 and 70, are frictionally received within sockets 64 and 66 so that the cross bars 68 and 70 are positioned parallel one another at a relatively short distance. A plurality of hooks members 84 are mounted between side frame members 12 and 14 on cross bars 68 and 70. As best shown in FIG. 3, the hook members 84 are comprised of a first sleeve 85, a second sleeve 86 and an upwardly extending hook 87. The first sleeve 85 and second sleeve 86 are telescoped by cross bars 68 and 70 respectively. Preferably, the hook members are loosely attached and are allowed to slide laterally along cross bars 68 and 70. The hooks 72 formed on side frame members 12, 14 and hook members 84 may be used to hang items having loops of string such as racquets, boxing gloves, protective eyewear, and various types of boots or skates. Also, athletic headgear such as baseball caps, football helmets, skating protection and other clothing could be suspended from hooks 72 and hook members 86.

As best shown in FIG. 1, the upper cross bar 68 cooperates with retaining bar 58 to provide an additional support area on rack 10. The cross bar 68 is preferably between 3 and 5 inches, and, most preferably, about 4 inches from retaining bar 58 and about 1.5 inches vertically lower than retaining bar 58. As shown in FIG. 4, the cross bar 68 and retaining bar 58 are exceptionally effective for storing softballs 73 having diameters of about 3.82 inches. Finally, retaining bars 56 and 58 and cross bar 68 are particularly effective for retaining shoes in a downwardly oriented manner.

Figure 6:
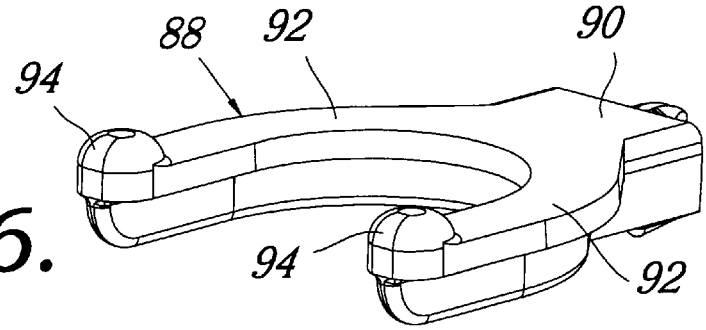
FIG. 6 is a right, frontal perspective view of a bat holding member of the present invention.
Figure 7:
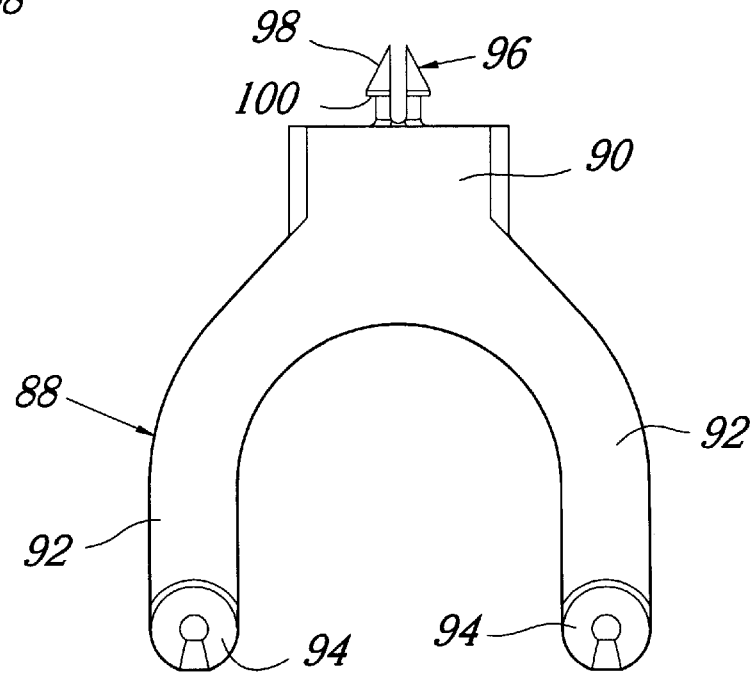
FIG. 7 is a top plan view of a bat holding member of the present invention.

In the preferred embodiment, a pair of bat holding members 88 are mounted to support arms 18 of side frame members 12, 14. As shown in FIGS. 6 and 7, each bat holding member 88 has a base 90. A pair of holding arms 92 forming a generally truncated sleeve defining an opening for receipt of a bat handle. At the end of each arm 92, a nub 94 in the shape of a hemisphere is formed on the upper surface to prevent the bat from sliding off of the bat holding member 88. Each holding member 88 is secured to the support arm 18 by a pair of flexible snap arms 96 formed on base 90 of the bat holding member 88. The snap arms 96 are positioned parallel to one another and separated by a small space. The outer face of each arm has an angular protuberance 98 terminating at an edge 100 perpendicular to the shaft of the snap arms 96. To secure the bat holding members 88 on side frame members 12, 14, the snaps arms 96 are directed into apertures 102, 104 on support arms 18. As the circumferential edge of aperture 102, 104 contacts protuberance 98, the support arms are deflected inwardly. When edge 100 clears the inner edge of the aperture, the snap arms 96 are allowed to expand to their undeflected shape. The frictional engagement between the snap arms 96 and support arms 18 securely maintains the bat holding member in place on the rack with holding arms 92 aligned horizontally. The bat holding members 88 may be removed from the sports equipment rack 10 if the rack is attached to the back of a door to prevent bats from swinging into contact with the door.

Retaining bars 44, 46, 52, 54, 56 and 58 and cross bars 68 and 70 are preferably formed of a lightweight, sturdy material such as aluminum or steel. In the preferred embodiment, the bars are elongated cylindrical members with a diameter of about one half of an inch. It will be appreciated that the side frame members, the retaining bars, and the cross bars can be constructed of any suitable material such as plastic or wood or any subcombination thereof.

Figure 8:
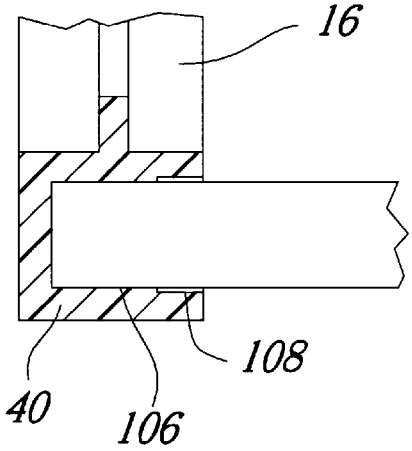
FIG. 8 is an enlarged fragmentary view illustrating the attachment structure utilized with the present invention.

Additionally, FIG. 8 illustrates one of the plurality of sockets utilized by the present invention for receiving an outer end of a retaining bars such as, in this instance, retaining bar 44. As disclosed and discussed in U.S. Pat. No. 5,695,073, assigned to assignee of the present invention and incorporated herein by reference, receiving socket 40 includes a first portion 106 having an inner diameter and a second portion 108 having an outer diameter, the outer diameter being slightly greater than the inner diameter. It has been found that this arrangement permits the structure to be easily assembled.

Specifically, during assembly, a first side member, such as side frame member 12, may be laid on a flat surface and the various retaining bars 44, 46, 52, 54, 56, and 58, and cross bars 68 and 70 are loosely positioned within the second, outer portion 108 of corresponding receiving sockets 40, 42, 48, 50, 60, 62 and 64 and 66 respectively. The hook members 84 are then placed on cross bars 68 and 70. Then, side frame member 14 may then be positioned downwardly onto the retaining bars, wherein the retaining bars are similarly loosely positioned within the outermost large diameter portion 98 of the receiving sockets. It will be appreciated that, with the retaining bars only loosely positioned within the outermost large diameter areas 108, the bars are less rigid than when snugly secured within the innermost, smaller diameter area 106 of the receiving sockets. As such, the bars may be manipulated to align with the receiving sockets on opposing side frame member 14, so that the bars may be placed within the larger diameter area of the corresponding receiving sockets in the side frame member 14.

Once all the bars are properly aligned, and loosely positioned within the outer, larger diameter area 108 of the corresponding receiving sockets, the side frame members 12, 14 may be depressed together, thus forcing the bars into the innermost, smaller diameter areas of the receiving sockets, thereby rigidly attaching the retaining bars to the side frame members 12, 14. The receiving socket structure of the present invention, having the first and second peripheral dimensions of different sizes, facilitate insertion an alignment of retaining bars 44, 46, 52, 54, 56 and 58 and the overall easy assembly of sports equipment rack 10. Finally, the bat holding members 88 are secured to support arms by snaps arms 96 as described above.

From the foregoing it will be seen that this invention is one well adapted to attain all ends and objects hereinabove set forth together with the other advantages which are obvious and which are inherent to the stricture. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative, and not in a limiting sense.

What is claimed is:

1. A sports equipment rack, for hanging on an upright surface, said sports equipment rack comprising:

first and second side frame members, each said frame member having a main body section and a plurality of support arms projected outwardly, and angled upwardly, from said main body section;

a plurality of retaining bars extending between said support arms, for retaining sports equipment, wherein said retaining bars are oriented in pairs, each said pair of retaining bars aligned in a plane forming an acute angle with respect to vertical, to thereby support sports equipment in an angular manner, with the sports equipment directed downwardly toward the upright surface;

wherein said plurality of retaining bars includes at least two pairs of retaining bars, each pair of said plurality of retaining bars including a first retaining bar and a second retaining bar, wherein the distance between said first retaining bar and said second retaining bar of at least one of said pairs is different than the distance between said first retaining bar and said second retaining bar of at least one other of said pairs, and wherein each said pair of retaining bars is positioned such that sports equipment supported and resting on a pair of said retaining bars is spacially removed from said upright surface, and wherein at least one of said pairs of retaining bars is positioned such that a ball supported thereon which rolls into contact with the upright surface will roll back into a cradled position, on said pair of retaining bars, in which the ball does not contact the upright surface, wherein said first retaining bar of each said pair is positioned proximate an outer end of a corresponding pair of said support arms on said opposed side frame members and said second retaining bar of said each pair is positioned on said corresponding pair between said first retaining bar and said opposing side frame members wherein said first retaining bar of each said pair is oriented vertically lower than said second retaining bar of each said pair, wherein the distance between said first retaining bar and said second retaining bar of one of said pairs of retaining bars is within the range of 2.5–3.5 inches; and horizontal support member coupling said main body sections of said first and second frame members, said horizontal support member fixably attached to said first and second frame members at a position vertically lower than said plurality of said support arms.

2. The sports equipment rack, according to claim 1, wherein the distance between said first retaining bar and said second retaining bar of each of said pairs of retaining bars is different.

3. The sports equipment rack, according to claim 2, wherein the distance between said first retaining bar and said second retaining bar of each said pair is greater than the distance between said first retaining bar and said second retaining bar of said pairs of retaining bars positioned vertically lower than each said pair.

4. The sports equipment rack, according to claim 3, wherein said plurality of retaining bars comprises three pairs of retaining bars.

5. The sports equipment rack, according to claim 1, wherein the distance between said first retaining bar and said second retaining bar of one of said pairs of retaining bars is within the range of 4.5–6 inches.

6. The sports equipment rack, according to claim 5, wherein the distance between said first retaining bar and said second retaining bar of one of said pairs of retaining bars is about 5.4 inches.

7. The sports equipment rack, according to claim 5, wherein said acute angle is between 63°–72°.

8. The sport equipment rack, according to claim 7, wherein said acute angle is about 68°.

9. The sports equipment rack, according to claim 1, wherein the distance between said first retaining bar and said second retaining bar of one of said pairs of retaining bars is within the range of 4–6 inches.

10. The sports equipment rack, according to claim 9, wherein the distance between said first retaining bar and said second retaining bar of one of said pairs of retaining bars is about 4.9 inches.

11. The sports equipment rack, according to claim 9, wherein said acute angle is between 60°–70°.

12. The sport equipment rack, according to claim 11, wherein said acute angle is about 66°.

13. The sports equipment rack, according to claim 12, wherein the distance between said first retaining bar and said second retaining bar of one of said pairs of retaining bars is about 3.1 inches.

14. The sports equipment rack, according to claim 12, wherein said acute angle is between 60°–70°.

15. The sport equipment rack, according to claim 14, wherein said acute angle is about 65.5°.

16. The sports equipment rack, according to claim 1, wherein the distance between said horizontal support member and said second retaining bar is between 3–5 inches.

17. The sports equipment rack, according to claim 16, wherein the distance between said horizontal support member and said second retaining bar is about 4 inches.

18. The sports equipment rack, according to claim 16, wherein the horizontal support member is about 1.5 inches vertically lower than said second retaining bar.

19. The sports equipment rack, according to claim 1, further comprising a plurality of hooks attached to said horizontal support member, wherein each of said hooks opens outwardly from said vertical surface.

20. The sports equipment rack, according to claim 1, wherein each of said support arms is arcuate and upwardly concave.

21. The sports equipment rack, according to claim 1, wherein the distance between said support arms decreases from the top of each said frame member to the bottom of each said frame member when the rack is secured to an upright surface.

22. The sports equipment rack, according to claim 1, wherein each of said frame members further comprises a plurality of bracing members, each of said bracing members having first and second ends, said first end of said bracing member fixably attached to one of said support arms at a position proximate the outer end of said support arm, said second end of said bracing member fixably attached to said main body section of said frame member at a position vertically higher than the intersection of said support arm and said main body section, wherein said bracing member traverses the side sections of the sports equipment to form a barrier against lateral movement of the sports equipment.

23. The sports equipment rack, according to claim 22, wherein each of said plurality of bracing members is arcuate.

24. The sports equipment rack, according to claim 23, wherein each of said plurality of bracing members is downwardly concave.

25. A rack, for hanging articles on an upright surface, said rack comprising:

first and second side frame members, each said frame member having a main body section and a plurality of support arms projected outwardly, and angled upwardly, from said main body section; and each main body section of said first and second side frame members including a downwardly extending prong, said prong having inner and outer surfaces, wherein said outer surface of said prong is substantially flush with the upright surface;

a horizontal support member coupling said main body sections of said first and second frame members said horizontal support member fixably attached to said first and second frame members in a position vertically lower than said plurality of said support arms; and a plurality of hooks fixably attached to said support member wherein each of said hooks opens outwardly from said vertical surface.

26. The rack, according to claim 25, further comprising a plurality of retaining bars extending between said support arms, for retaining articles, wherein said retaining bars are oriented in pairs, each said pair of retaining bars aligned in a plane forming an acute angle with respect to vertical, to thereby support articles in an angular manner, with the articles directed downwardly toward the upright surface.

27. The rack, according to claim 26, wherein said prong is integrally formed within each of said main body sections.

28. The rack, according to claim 25, wherein the distance between said first retaining bar and said second retaining bar of at least one of said pairs is different than the distance between said first retaining bar and said second retaining bar of at least one other of said pairs.

29. The rack, according to claim 28, wherein each of said pairs of retaining bars include a first retaining bar positioned proximate an outer end of a corresponding pair of said support arms on said opposed side frame members, and a second retaining bar positioned on said corresponding pair of said support arms between said first retaining bar and said opposing side frame members, wherein said first retaining bar is oriented vertically lower than said second retaining bar.

30. The rack, according to claim 25, wherein said prong is integrally formed within each of said main body sections.

31. The rack, according to claim 25, wherein the distance between said first retaining bar and said second retaining bar of each of said pairs of retaining bars is different.

32. The rack, according to claim 31, wherein the distance between said first retaining bar and said second retaining bar of each said pair is greater than the distance between said first retaining bar and said second retaining bar of said pairs of retaining bars positioned vertically lower than each said pair.

33. The rack, according to claim 25, wherein said plurality of retaining bars comprises three pairs of retaining bars.

34. The rack, according to claim 25, wherein each of said support arms is arcuate and upwardly concave.

35. The sports equipment rack, according to claim 25, wherein the distance between said support arms decreases from the top of each said frame member to the bottom of each said frame member when the rack is secured to an upright surface.

36. The rack, according to claim 25, wherein each of said frame members further comprises a plurality of bracing members, each of said bracing members having first and second ends, said first end of each said bracing member fixably attached to one of said support arms at a position proximate the outer end of said support arm, said second end of each said bracing member fixably attached to said main body section of said frame member at a position vertically higher than the intersection of said support arm and said main body section, wherein said bracing member traverses the side sections of the sports equipment to form a barrier against lateral movement of the articles.

37. The rack, according to claim 36, wherein each of said plurality of bracing members is arcuate.

38. The rack, according to claim 36, wherein each of said plurality of bracing members is downwardly concave.

39. The rack, according to claim 25, further comprising a bat holding member attached to at least one of said support arms, said bat holder member comprising a truncated sleeve defining a generally circular opening.

* * * * *